US011808242B2

(12) United States Patent
Dong et al.

(10) Patent No.: US 11,808,242 B2
(45) Date of Patent: Nov. 7, 2023

(54) HIGH-PRESSURE FUEL PUMP

(71) Applicant: Robert Bosch GmbH, Stuttgart (DE)

(72) Inventors: Ziang Dong, Wuxi (CN); Xiaoyan Jiang, Wuxi (CN); Yingsa Huang, Wuxi (CN)

(73) Assignee: Robert Bosch GmbH, Stuttgart (DE)

( * ) Notice: Subject to any disclaimer, the term of this patent is extended or adjusted under 35 U.S.C. 154(b) by 98 days.

(21) Appl. No.: 17/394,968

(22) Filed: Aug. 5, 2021

(65) Prior Publication Data

US 2022/0049674 A1 Feb. 17, 2022

(30) Foreign Application Priority Data

Aug. 11, 2020 (CN) ..... 202010799987.3

(51) Int. Cl.

| | |
|---|---|
| ***F02M 59/08*** | (2006.01) |
| ***F02M 59/12*** | (2006.01) |
| ***F02M 59/10*** | (2006.01) |
| ***F04C 2/344*** | (2006.01) |
| ***F04C 15/00*** | (2006.01) |
| ***F04B 23/08*** | (2006.01) |
| ***F04B 53/00*** | (2006.01) |
| ***F04B 53/16*** | (2006.01) |

(52) U.S. Cl.

CPC ..... *F02M 59/08* (2013.01); *F02M 59/102* (2013.01); *F02M 59/12* (2013.01); *F04B 23/08* (2013.01); *F04B 53/006* (2013.01); *F04B 53/16* (2013.01); *F04C 2/3446* (2013.01); *F04C 15/0061* (2013.01); *F04C 2210/1044* (2013.01); *F04C 2240/10* (2013.01); *F04C 2240/20* (2013.01)

(58) Field of Classification Search

CPC ..... F02M 59/08; F02M 59/102; F02M 59/12; F04B 23/08; F04B 53/006; F04B 53/16; F04C 2/3346; F04C 15/0061; F04C 2210/1044; F04C 2240/10; F04C 2240/20

See application file for complete search history.

(56) References Cited

U.S. PATENT DOCUMENTS 5,996,557 A * 12/1999 Muraki ..... F02M 41/128 123/502

2004/0136852 A1* 7/2004 Hedrick ..... F04C 28/28 418/2

FOREIGN PATENT DOCUMENTS

WO WO-2005038234 A1 * 4/2005 ..... F02M 59/102

* cited by examiner

*Primary Examiner* — Connor J Tremarche

(74) *Attorney, Agent, or Firm* — Maginot, Moore & Beck LLP

(57) ABSTRACT

A high-pressure fuel pump includes a drive shaft, and a vane pump and a plunger pump which are driven by the drive shaft. The vane pump is configured to supply pre-pressurized fuel to the plunger pump. The drive shaft includes a cam configured to drive a piston rod of the plunger pump such that the plunger pump alternately executes a fuel suction stroke and a fuel discharge stroke. The drive shaft further includes a shaft portion for driving a rotor of the vane pump. The vane pump is configured such that for each fuel suction stroke of the plunger pump the vane pump provides a fuel supply cycle that is advanced by a phase angle relative to the fuel suction stroke.

10 Claims, 4 Drawing Sheets

HIGH-PRESSURE FUEL PUMP

This application claims priority under 35 U.S.C. § 119 to patent application no. CN 202010799987.3, filed on Aug. 11, 2020 in China, the disclosure of which is incorporated herein by reference in its entirety.

BACKGROUND

The present application relates to a high-pressure fuel pump, having improved fuel supply pump fuel supply performance.

A typical high-pressure fuel pump comprises a low-pressure assembly and a high-pressure assembly. A vane pump in the low-pressure assembly is configured to supply fuel to the high-pressure assembly; a plunger pump in the high-pressure assembly sucks in the fuel supplied by the vane pump, pressurizes the fuel to a high pressure and then outputs same.

This type of high-pressure fuel pump experiences the problem of inadequate fuel output capability at certain speeds, in particular in a high-speed region. The applicant has discovered that this problem is due to the reason described below, at least to a certain extent: the phases of a fuel suction stroke of the plunger pump and a fuel supply cycle of the vane pump are synchronized. In one fuel suction stroke of the plunger pump, the plunger pump's demand for the fuel suction amount rises gradually to a peak, and then falls. In one fuel supply cycle of the vane pump, the fuel supply amount of the vane pump experiences a process of falling from a high point to a trough and then rising from the trough. When the phases of the fuel suction stroke of the plunger pump and the fuel supply cycle of the vane pump are synchronized, the trough in the fuel supply amount of the vane pump corresponds in phase to a region of high fuel suction demand of the plunger pump; thus, the fuel supply characteristic of the vane pump cannot be matched to the fuel suction demand of the plunger pump, resulting in inadequate fuel output capability of the high-pressure fuel pump.

SUMMARY

The object of the present application is to solve the problem of inadequate fuel output capability in high-pressure fuel pumps.

To this end, according to one aspect of the present application, a high-pressure fuel pump is provided, comprising:

a drive shaft, and a vane pump and a plunger pump which are driven by the drive shaft, the vane pump being configured to supply pre-pressurized fuel to the plunger pump;

wherein the drive shaft comprises a cam, configured to drive a piston rod of the plunger pump, such that the plunger pump executes a working cycle consisting of a fuel suction stroke and a fuel discharge stroke alternating with each other;

the drive shaft further comprises a shaft portion for driving a rotor of the vane pump;

the vane pump is configured such that for each fuel suction stroke of the plunger pump, the vane pump provides a fuel supply cycle that is advanced by an advance phase angle relative to the fuel suction stroke.

According to a feasible embodiment, the vane pump is configured such that a starting point of each fuel suction stroke of the plunger pump falls within a trough of one fuel supply cycle of the vane pump; and/or an end point of the fuel suction stroke falls within a trough of the following fuel supply cycle of the vane pump.

According to a feasible embodiment, the vane pump comprises multiple radially slidable vanes borne by the rotor, the multiple vanes being uniformly distributed at equal angular intervals, and the range of values of the advance phase angle is greater than 0° and less than half of an included angle between two vanes adjacent to each other in the circumferential direction.

According to a feasible embodiment, the number of the vanes is 1 or more multiple of the number of working cycles completed by the plunger pump in each revolution of the drive shaft, such that the number of fuel supply cycles provided by the vane pump in each revolution of the drive shaft is 1 or more multiple of the number of working cycles completed by the plunger pump.

According to a feasible embodiment, the fuel suction stroke of the plunger pump starts at a top stopping point of the piston rod, and each fuel supply cycle of the vane pump starts when one of the multiple vanes is located at the position of a minimum gap between the rotor and a stator of the vane pump.

According to a feasible embodiment, when one of the vanes of the vane pump is located at the position of the minimum gap between the rotor and stator of the vane pump, the highest point of a cam lobe of the cam is disposed at a point which is offset from the vertical direction by an offset angle in the opposite direction to the rotation direction of the drive shaft, the value of the offset angle being equal to the advance phase angle.

According to a feasible embodiment, the piston rod of the plunger pump is oriented in the vertical direction, the shaft portion is connected to the rotor via a key, a radial center line of the key equally divides an included angle between two vanes adjacent to each other in the circumferential direction, and when the radial center line of the key lies in the vertical direction, one of the multiple vanes is located at the position of the minimum gap between the rotor and stator of the vane pump.

According to a feasible embodiment, the plunger pump comprises a single piston rod, the cam comprises a pair of cam lobes (6) which are arranged opposite one another and configured to drive the piston rod, the number of the vanes is 4, and in each revolution of the drive shaft, the plunger pump completes two working cycles and the vane pump completes four fuel supply cycles.

According to a feasible embodiment, when one of the vanes of the vane pump is located at the position of a minimum gap between the rotor and a stator of the vane pump, the highest point of one of the pair of cam lobes is located at a point which is offset from the vertical direction by 20°-35°, preferably about 30°, in the opposite direction to the rotation direction of the drive shaft.

According to a feasible embodiment, the position of the minimum gap between the rotor and stator of the vane pump is disposed at a point which is offset from the vertical direction by about 25° in the rotation direction of the drive shaft.

According to the present application, the phase of the fuel suction stroke of the plunger pump is delayed by an angle relative to the phase of the fuel supply cycle of the vane pump. This delay angle enables the peak in fuel suction demand of the plunger pump to avoid the trough in the fuel supply amount of the vane pump. Thus, the fuel supply characteristic of the vane pump is matched as closely as possible to the fuel suction demand of the plunger pump, thereby increasing the fuel output capability of the high-pressure fuel pump, especially the fuel output capability in a high speed region.

BRIEF DESCRIPTION OF THE DRAWINGS

A more complete understanding of the abovementioned and other aspects of the present application will be gained from the following detailed description which makes reference to the drawings, wherein.

DETAILED DESCRIPTION

Figure 1:
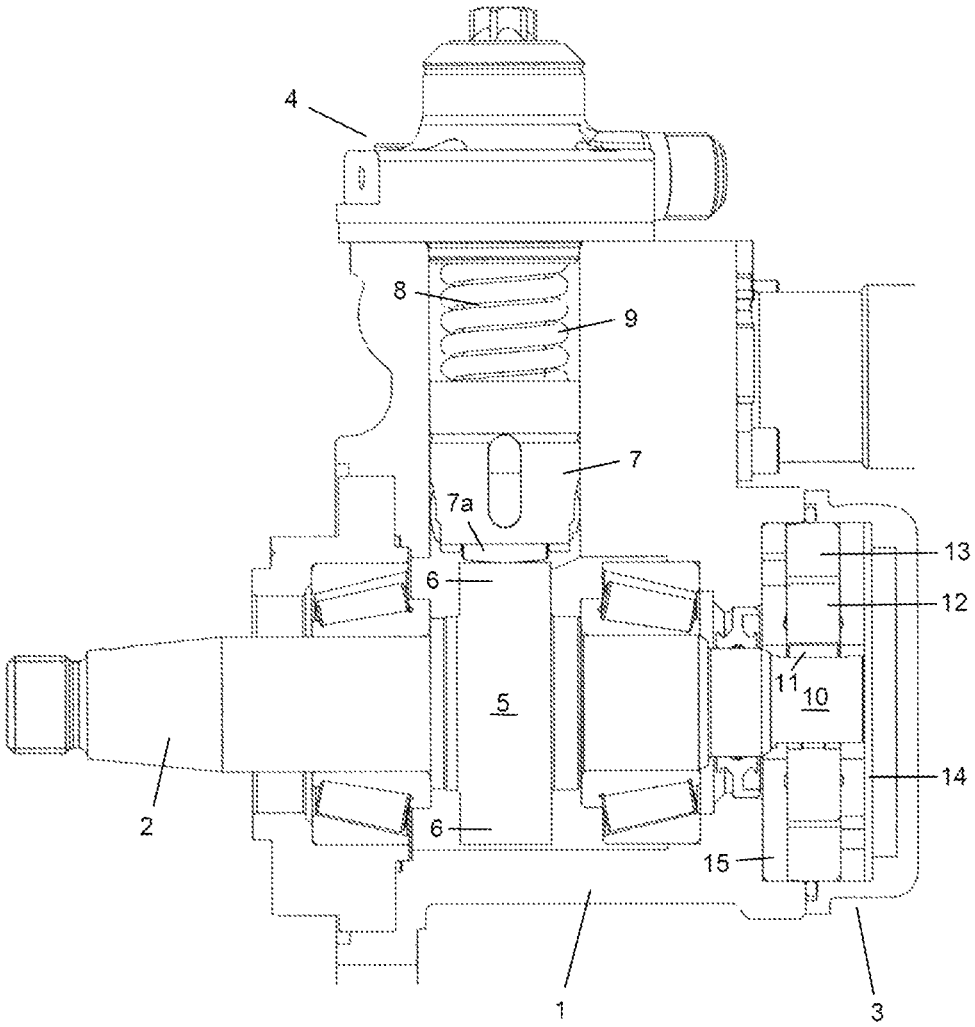
FIG. 1 is a schematic drawing of the high-pressure fuel pump according to a feasible embodiment of the present application.

Some embodiments of the present application are described below with reference to the drawings. FIG. 1 shows the overall configuration of a feasible embodiment of the high-pressure fuel pump of the present application, in particular a high-pressure diesel pump. The high-pressure fuel pump can be used to supply high-pressure fuel to a fuel rail (not shown), which then injects the fuel via a nozzle into an engine (not shown), in particular a diesel engine.

The high-pressure fuel pump in FIG. 1 mainly comprises: a housing 1; a drive shaft 2 supported by the housing 1; and a vane pump 3 and a plunger pump 4, which are combined with the housing 1 and jointly driven by the drive shaft 2.

A main body part of the drive shaft 2 is arranged substantially horizontally in an accommodating cavity formed in the housing 1, and is formed with a cam 5 for driving the plunger pump 4. The cam 5 comprises a pair of cam lobes 6 which are spaced apart by 180° in the circumferential direction and rotationally symmetrical. The plunger pump 4 comprises a tappet 7 that is driven by the cam 5 to reciprocate up and down, a piston rod 8 that is driven by the tappet 7 to reciprocate up and down, and a return spring 9 that surrounds the piston rod 8 and pushes against the tappet 7. The return spring 9 maintains contact between a roller 7*a* in the tappet 7 and a cam face of the cam 5.

As the drive shaft 2 rotates, the cam face of the cam 5 controls the plunger pump 4 to complete a working cycle thereof, each working cycle comprising a fuel discharge stroke and a fuel suction stroke in succession. In the fuel discharge stroke, the cam lobe 6 pushes the roller 7*a*, the tappet 7 moves upward, and the piston rod 8 pushes fuel in a piston chamber of the plunger pump 4, such that the fuel is discharged in a pressurized state. When a top stopping point in the cam curve of the cam 5 (i.e. a top stopping point of the piston rod 8) is reached, the fuel discharge stroke ends, and is followed by the fuel suction stroke. In the fuel suction stroke, under the action of the return spring 9, the tappet 7 and the piston rod 8 move downward, the volume of the piston chamber increases, and fuel is sucked into the piston chamber from the vane pump 3. The fuel suction stroke starts at the top stopping point in the cam curve of the cam 5, and ends at an angle after the top stopping point, e.g. equal to or less than 90°, depending on the shape of the cam lobe 6. In other words, the fuel suction stroke can be joined to the starting point of the next fuel discharge stroke, or end at an angle before the starting point of the next fuel discharge stroke. In the case shown in FIG. 1, in which the cam 5 comprises two cam lobes 6, the plunger pump 4 completes two working cycles for each 360° rotation of the drive shaft 2.

An end shaft portion 10 of the drive shaft 2 is configured to drive the vane pump 3. Specifically, the end shaft portion 10 is connected to a rotor 12 of the vane pump 3 via a key 11. The vane pump 3 further comprises a stator 13 arranged eccentrically around the rotor 12, and fuel distribution plates 14, 15 located at two sides in the axial direction of the rotor 12 and stator 13.

Figure 2:
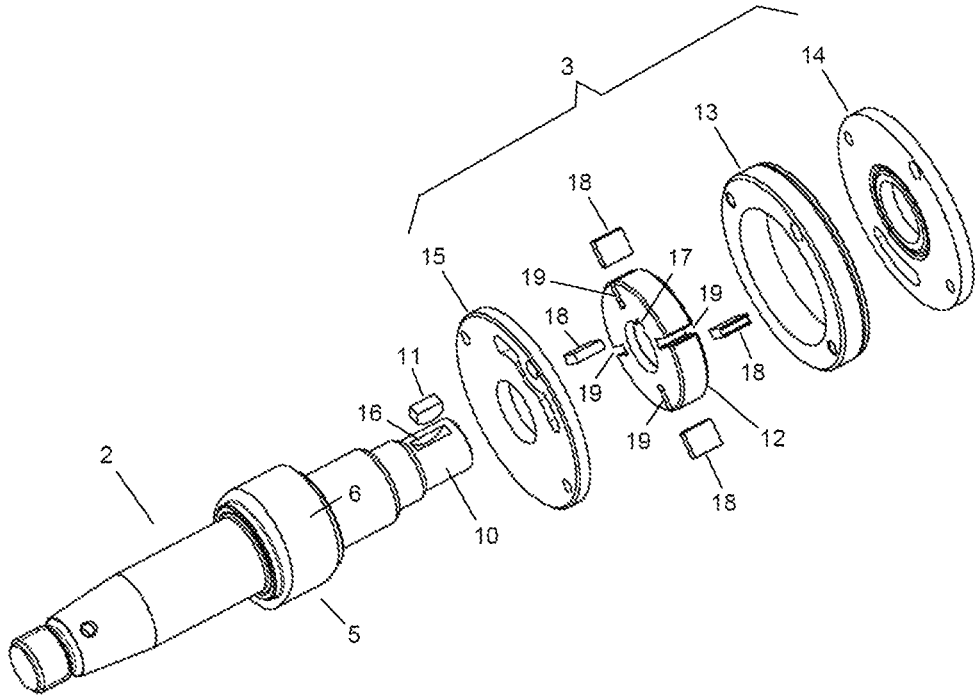
FIG. 2 is an exploded drawing of the main component elements of the vane pump and the drive shaft used in the high-pressure fuel pump shown in FIG. 1.

FIG. 2 shows an exploded drawing of the drive shaft 2 and the vane pump 3. As can be seen, the key 11 is positioned in a key slot 16 on the end shaft portion 10 and in a key slot 17 in the rotor 12. Four vanes 18 are slidably inserted in corresponding vane slots 19 formed on the rotor 12.

The rotation of the drive shaft 2 drives the vane pump 3 to output fuel toward the plunger pump 4 side. The flow rate of fuel outputted by the vane pump 3 is not constant, but in a pulsating form. For each 360° rotation of the drive shaft 2, the vane pump 3 experiences four fuel output cycles. In each fuel output cycle, the fuel flow rate has a trough and a peak, as described in detail below.

Figure 3:
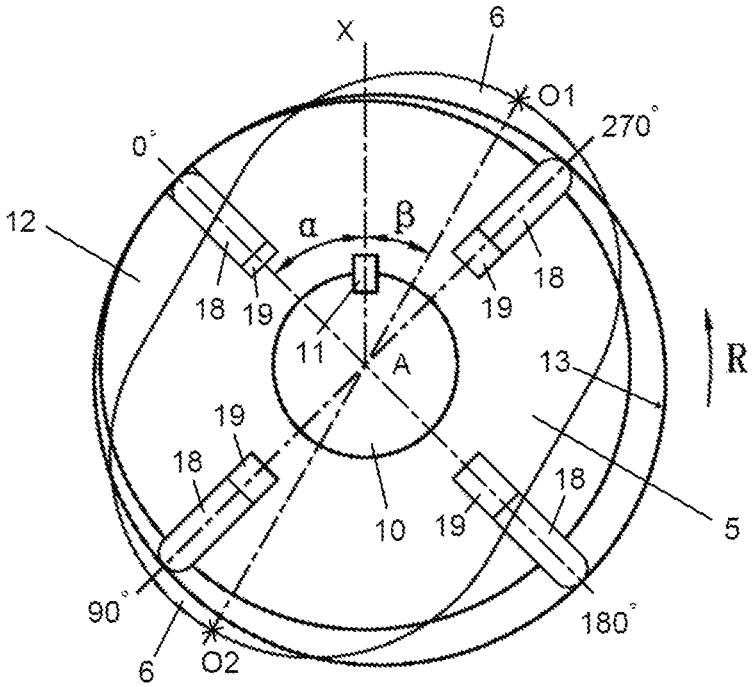
FIG. 3 is a schematic drawing showing an exemplary positional relationship between the drive shaft and vane pump shown in FIG. 2.

FIG. 3 shows an exemplary positional relationship of the cam 5 and the rotor 12, stator 13 and vanes 18 of the vane pump 3, viewed along a central axis A of the drive shaft 2. It must be pointed out that FIG. 3 merely serves an explanatory purpose, and therefore is not drawn to scale; moreover, for the sake of clarity, some details have been omitted.

In FIG. 3, the direction X represents the vertical direction; the piston rod 8 of the plunger pump 4 (not shown in FIG. 3) is arranged in the vertical direction X. The position of a zero gap (or minimum gap) between an outer periphery of the rotor 12 of the vane pump 3 and an inner periphery of the stator 13 is defined as the 0° angular position of the rotor 12; the 0° angular position is located at a point which is offset by an angle $\alpha$ ($\alpha$ being equal to 45°) with respect to the vertical direction X in the rotation direction of the rotor 12 (i.e. the rotation direction of the drive shaft 2) R. At the starting point of each fuel output cycle of the vane pump 3, the four vanes 18 are located at the 0°, 90°, 180° (the position of the maximum gap between the rotor and the stator 13) and 270° angular positions of the rotor 12 respectively.

The key 11 is disposed at a middle position between two vane slots 19, i.e. a radial center line of the key 11 forms an included angle of 45° with a radial central axis of any vane 18 which is adjacent in the circumferential direction. When one vane 18 is located at the 0° angular position of the rotor 12, the radial center line of the key 11 is located above, or below, or at the left side, or at the right side of the central axis A of the drive shaft 2 in the vertical direction X or a horizontal direction. One of four feasible positions of the key 11 (above the central axis A) is shown in FIG. 3.

For this exemplary configuration, according to the prior art, a connecting line O1O2 between cam top points O1, O2 of the two cam lobes 6 of the cam 5 is parallel to the radial center line of the key 11; that is to say, at a top stopping point in the cam curve of the cam 5, one vane 18 is located at the 0° angular position of the rotor 12, and the radial center line of the key 11 and the connecting line O1O2 between the cam top points of the cam lobes 6 are both oriented in the vertical direction X, such that the phases of the fuel suction stroke of the plunger pump 4 and a corresponding fuel supply cycle of the vane pump 3 are synchronized.

According to the present application, when one vane 18 is located at the 0° angular position of the rotor 12, the connecting line O1O2 between the cam top points of the two cam lobes 6 of the cam 5 is offset from the vertical direction X by an angle β in the opposite direction to the rotation direction R of the rotor 12; the offset angle β is greater than 0° and less than half of the included angle between vanes 18 adjacent to each other in the circumferential direction.

Figure 4:
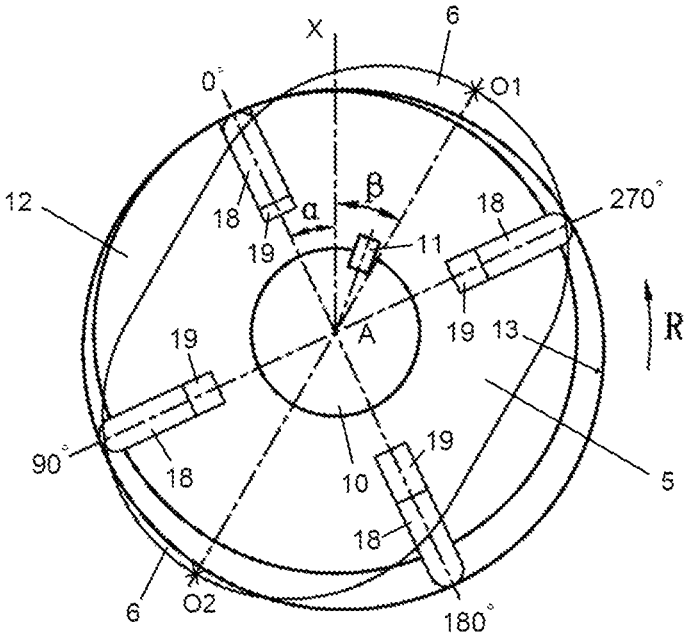
FIG. 4 is a schematic drawing showing another exemplary positional relationship between the drive shaft and vane pump shown in FIG. 2.

It must be pointed out that the 0° angular position of the rotor 12 does not need to be located at the point that is offset by 45° with respect to the vertical direction X in the rotation direction R of the rotor 12, but can be disposed at any suitable angle relative to the vertical direction X. For example, FIG. 4 shows another exemplary positional relationship of the cam 5 and the rotor 12, stator 13 and vanes 18 of the vane pump 3, viewed along the central axis A of the drive shaft 2. Likewise, it must by pointed out that FIG. 4 merely serves an explanatory purpose, and therefore is not drawn to scale; moreover, for the sake of clarity, some details have been omitted. In the example shown in FIG. 4, the 0° angular position of the rotor 12 is located at a point which is offset by an angle α of about 25° with respect to the vertical direction X in the rotation direction R of the rotor 12. As in the example shown in FIG. 3, when one vane 18 is located at the 0° angular position of the rotor 12, the connecting line O1O2 between the cam top points of the two cam lobes 6 of the cam 5 is offset from the vertical direction X by an angle β in the opposite direction to the rotation direction R of the rotor 12; the offset angle β is greater than 0° and less than half of the included angle between vanes 18 adjacent to each other in the circumferential direction.

Due to the existence of the offset angle β, the fuel suction stroke of the plunger pump 4 lags behind a corresponding fuel supply cycle of the vane pump 3 by the angle β, such that the region of high fuel suction demand of the plunger pump 4 avoids the trough in the fuel supply amount of the vane pump 3.

The size of the offset angle β can be determined by simulation or experiment, so that the fuel suction stroke of the plunger pump 4 is as closely matched as possible to the fuel supply cycle of the vane pump 3, for example such that the region of high fuel suction demand of the plunger pump 4 is wholly located within a region that the fuel supply capability of the vane pump 3 can satisfy. For example, in the examples of FIGS. 3 and 4, the offset angle β is set at 20°-35°, preferably about 30°.

Figure 5:
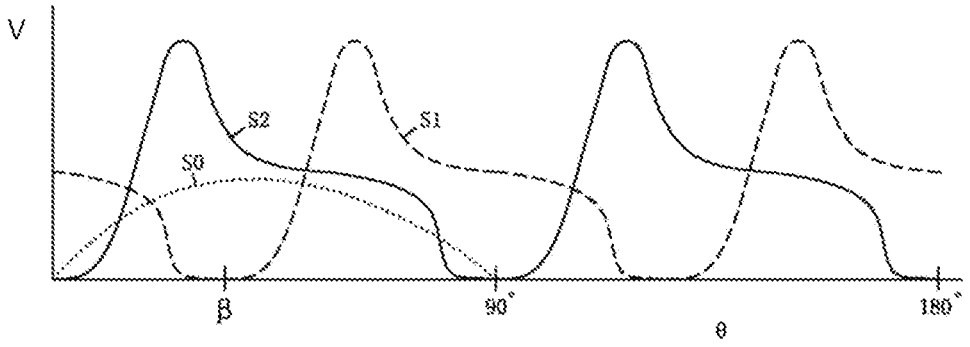
FIG. 5 is a graph of the plunger pump fuel suction stroke and the vane pump fuel supply cycle, matched to each other, in the high-pressure fuel pump of the present application.

The improvement in matching between the fuel suction stroke of the plunger pump 4 and the fuel supply cycle of the vane pump 3 in the present application can be seen from FIG. 5. In FIG. 5, the horizontal coordinate represents the rotation angle of the drive shaft 2 (i.e. the rotation angle of the rotor 12 and the cam 5), and the vertical coordinate represents the fuel suction demand of the plunger pump 4 and the fuel supply amount of the vane pump 3. In the figure, the curve S0 represents the fuel suction demand in one fuel suction stroke of the plunger pump 4, the curve S1 represents two fuel supply cycles of the vane pump 3 in the prior art, and the curve S2 represents two fuel supply cycles of the vane pump 3 in the present application.

It can be seen from a comparison of curves S0 and S1 in FIG. 5 that according to the prior art, the phases of the fuel suction stroke of the plunger pump and one fuel supply cycle of the vane pump are synchronized, such that the region of high fuel suction demand in this fuel suction stroke of the plunger pump falls within the trough in the fuel supply amount of the vane pump, with the result that the fuel supply capability of the vane pump does not meet the fuel suction demand of the plunger pump, so the fuel output capability of the high-pressure fuel pump is inadequate.

In contrast, it can be seen from a comparison of curves S0 and S2 in FIG. 5 that according to the present application, the fuel suction stroke of the plunger pump lags behind the fuel supply cycle of the vane pump by a phase angle β (e.g. 30°). That is to say, relative to each fuel suction stroke of the plunger pump, the vane pump can provide a fuel supply cycle that is advanced by the phase angle β. Consequently, the region of high fuel suction demand in one fuel suction stroke of the plunger pump falls within the region of large fuel supply amount of the vane pump. Preferably, the starting point of the fuel suction stroke falls within the trough of the previous fuel supply cycle of the vane pump, and/or the end point of the fuel suction stroke falls within the trough of the next fuel supply cycle of the vane pump. This makes it possible for the fuel supply capability of the vane pump to satisfy the fuel suction demand of the plunger pump substantially perfectly, so the fuel output capability of the high-pressure fuel pump is increased.

Figure 6:
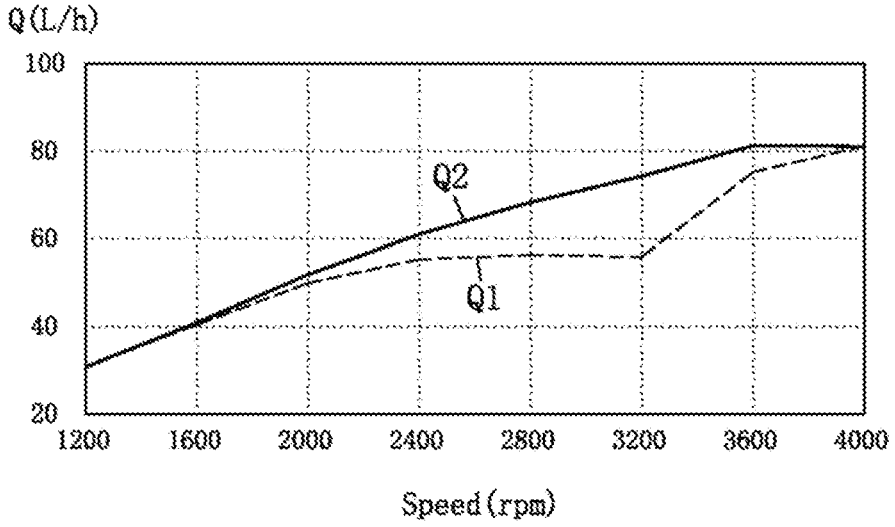
FIG. 6 is a graph showing the improvement in fuel output capability of the high-pressure fuel pump of the present application.

The increase in fuel output capability of the high-pressure fuel pump in the present application can be seen from the experimental curve in FIG. 6. In FIG. 6, the horizontal axis represents pump speed, i.e. the rotation speed of the drive shaft 2, and the vertical axis represents the fuel output amount of the high-pressure fuel pump. The curve Q1 is the fuel output amount of a high-pressure fuel pump according to the prior art at various pump speeds; the curve Q2 is the fuel output amount of the high-pressure fuel pump according to the present application at various pump speeds. It can be seen by comparing the two curves that in a high-speed region of the high-pressure fuel pumps, in particular the region from 2000 rpm to 3600 rpm, the fuel output amount of the high-pressure fuel pump according to the present application is obviously increased relative to the prior art.

In addition, it can also be seen from FIG. 6 that according to the prior art, within the region from 2400 rpm to 3200 rpm, as the pump speed increases, there is no corresponding increase in the fuel output amount of the high-pressure fuel pump, and this has a negative impact on engine performance at high speeds. In contrast, according to the present application, within the region from 1200 rpm to 3600 rpm, as the pump speed increases, the fuel output amount of the high-pressure fuel pump is always correspondingly increasing, and this improves engine performance at high speeds.

Furthermore, it can be seen from the description above that in the present application, for a fuel suction stroke of the plunger pump, the corresponding fuel supply cycle of the vane pump is advanced by an angle, such that when the plunger pump is drawing fuel, the output flow rate of the vane pump is larger, i.e. liquid pressure at a front end is higher when the plunger pump is drawing fuel, therefore the fuel suction efficiency of the plunger pump can be increased, thereby increasing the volumetric efficiency and fuel output capability of the high-pressure fuel pump.

The scope of the present application is not limited to the particular embodiments described above, but can be implemented in a broader sense. Feasible embodiments of the present application in a broad sense are described below.

Overall, the high-pressure fuel pump of the present application may comprise one or more plunger pump.

In the case where multiple plunger pumps are comprised, central axes of these plunger pumps may be arranged in parallel along the central axis of the drive shaft, or distributed at equal angular intervals relative to the central axis of the drive shaft; for each plunger pump, a corresponding cam is provided on the drive shaft, and each cam can have one lobe, or multiple lobes uniformly distributed in the circumferential direction. The plunger pumps and cam lobes should be distributed in such a way that in one revolution of the drive shaft, all of the working cycles of the plunger pumps (each comprising one fuel suction stroke and one fuel discharge stroke) are distributed at equal intervals within 360°.

Supposing that the high-pressure fuel pump of the present application comprises n (n being an integer ≥1) plunger pumps, each plunger pump being driven by m (m being an integer ≥1) cam lobes; then in one revolution of the drive shaft, the total number of working cycles of the plunger pumps is n*m. The number of vanes comprised in the vane pump is 1 or more multiple of the total number of working cycles of the plunger pumps in one revolution of the drive shaft, i.e. the number of vanes is n*m*k (k being an integer ≥1). Thus, relative to each fuel suction stroke of the plunger pump, the vane pump can provide at least one fuel supply cycle having an advance phase angle, such that in each fuel suction stroke of the plunger pump, the vane pump can supply ample pre-pressurized fuel to the plunger pump. The value of the advance phase angle is greater than 0° and less than half of the included angle between a pair of vanes adjacent to each other in the circumferential direction.

Account is taken of the fact that in actual production, the cam lobes on the drive shaft are generally formed in advance, and subsequently the key slot of the key for connecting the vane pump rotor is provided at a determined angular position. Thus, according to the present application, based on the determined position of the minimum gap between the rotor and stator of the vane pump and the advance phase angle of the vane pump, it is possible to determine the angular positional relationship between the key and the cam lobes, and the key slot can then be provided on the drive shaft. It must be pointed out that the number of feasible angular positions of the key slot is equal to the number of vanes, and one of these feasible angular positions can be selected as the actual angular position of the key slot.

In this respect it must also be pointed out that in the prior art described above, the key slot on the drive shaft has the same angular position as the cam lobe. According to the present disclosure, as stated above, the angular position of the cam lobe is associated with the phase of the fuel supply cycle of the vane pump rotor. After determining the eccentric position of the vane pump stator, the relationship between the angular position of the cam lobe and the phase of the vane pump rotor is determined, and the angular positions of the key slots on the vane pump rotor and the drive shaft can then be determined. In other words, according to the present application, the angular positional relationship between the key slot on the drive shaft and the cam lobe is not determined directly when the drive shaft is designed, as in the prior art; instead, the angular position of the key slot (key) needs to be determined on the basis of the angular position of the cam lobe, taking into account the angle of advance of the starting point of the fuel supply cycle of the vane pump relative to the top stopping point of the cam.

It must also be pointed out that although it is preferable for the key slot on the vane pump rotor to be provided at the angular position exactly halfway between two vane slots, this is not a requirement. In fact, the key slot on the vane pump rotor can be provided at any angular position relative to the vane slots.

In summary, according to the present application, as the fuel supply cycle provided by the vane pump has an advance phase angle with respect to the phase of the fuel suction stroke of the plunger pump, the fuel supply cycle of the vane pump is matched to the fuel suction stroke of the plunger pump, thus avoiding the situation in the prior art in which the trough in the fuel supply amount of the vane pump corresponds in phase to a region of high fuel suction demand of the plunger pump, and thereby increasing the fuel output capability of the high-pressure fuel pump.

Although the present application has been described here with reference to particular exemplary embodiments, the scope of the present application is not limited to the details shown. Various amendments could be made to these details without deviating from the basic principle of the present application.

What is claimed is:

1. A high-pressure fuel pump, comprising:

a drive shaft; and a vane pump and a plunger pump which are driven by the drive shaft, the vane pump being configured to supply pre-pressurized fuel to the plunger pump;

wherein the drive shaft comprises a cam configured to drive a piston rod of the plunger pump such that the plunger pump executes a working cycle consisting of a fuel suction stroke and a fuel discharge stroke alternating with each other, wherein the drive shaft further comprises a shaft portion for driving a rotor of the vane pump, wherein the vane pump is configured such that for each fuel suction stroke of the plunger pump the vane pump provides a fuel supply cycle that is advanced by an advance phase angle greater than 0° relative to the fuel suction stroke, and wherein the vane pump comprises multiple radially slidable vanes borne by the rotor, the multiple vanes being uniformly distributed at equal angular intervals, and a range of values of the advance phase angle is greater than 0° and less than half of an included angle between two vanes adjacent to each other in the circumferential direction.

2. The high-pressure fuel pump as claimed in claim 1, wherein:

the vane pump is configured such that a starting point of each fuel suction stroke of the plunger pump falls within a trough of one fuel supply cycle of the vane pump; and/or an end point of the fuel suction stroke falls within a trough of the following fuel supply cycle of the vane pump.

3. The high-pressure fuel pump as claimed in claim 1, wherein the number of the vanes is 1 or more multiple of the number of working cycles completed by the plunger pump in each revolution of the drive shaft such that the number of fuel supply cycles provided by the vane pump in each revolution of the drive shaft is 1 or more multiple of the number of working cycles completed by the plunger pump.

4. The high-pressure fuel pump as claimed in claim 3, wherein the fuel suction stroke of the plunger pump starts at a top stopping point of the piston rod, and each fuel supply cycle of the vane pump starts when one of the multiple vanes is located at the position of a minimum gap between the rotor and a stator of the vane pump.

5. The high-pressure fuel pump as claimed in claim 4, wherein when one of the vanes of the vane pump is located at the position of the minimum gap between the rotor and stator of the vane pump, the highest point of a cam lobe of the cam is disposed at a point which is offset from the vertical direction by an offset angle (β) in the opposite direction to the rotation direction of the drive shaft, the value of the offset angle being equal to the advance phase angle.

6. The high-pressure fuel pump as claimed in claim 4, wherein the piston rod of the plunger pump is oriented in the vertical direction, the shaft portion is connected to the rotor via a key, a radial center line of the key equally divides an included angle between two vanes adjacent to each other in the circumferential direction, and when the radial center line of the key lies in the vertical direction, one of the multiple vanes is located at the position of the minimum gap between the rotor and stator of the vane pump.

7. The high-pressure fuel pump as claimed in claim 1, wherein the plunger pump comprises a single piston rod, the cam comprises a pair of cam lobes which are arranged opposite one another and configured to drive the piston rod, the number of the vanes is 4, and in each revolution of the drive shaft, the plunger pump completes two working cycles and the vane pump completes four fuel supply cycles.

8. The high-pressure fuel pump as claimed in claim 7, wherein when one of the vanes of the vane pump is located at the position of a minimum gap between the rotor and a stator of the vane pump, the highest point of one of the pair of cam lobes is located at a point which is offset from the vertical direction by 20°-35° in the opposite direction to the rotation direction of the drive shaft.

9. The high-pressure fuel pump as claimed in claim 8, wherein the position of the minimum gap between the rotor and stator of the vane pump is disposed at a point which is offset from the vertical direction by about 25° in the rotation direction of the drive shaft.

10. The high-pressure fuel pump as claimed in claim 7, wherein when one of the vanes of the vane pump is located at the position of a minimum gap between the rotor and a stator of the vane pump, the highest point of one of the pair of cam lobes is located at a point which is offset from the vertical direction by about 30° in the opposite direction to the rotation direction of the drive shaft.

* * * * *